United States Patent [19]

Milde

[11] 4,133,649

[45] Jan. 9, 1979

[54] REDUCED POWER INPUT FOR IMPROVED ELECTROSTATIC PRECIPITATION SYSTEMS

[75] Inventor: Helmut I. Milde, Andover, Mass.

[73] Assignee: High Voltage Engineering Corporation, Burlington, Mass.

[21] Appl. No.: 821,084

[22] Filed: Aug. 2, 1977

Related U.S. Application Data

[63] Continuation of Ser. No. 609,708, Sep. 2, 1975, abandoned, which is a continuation-in-part of Ser. No. 422,401, Dec. 6, 1973, abandoned.

[51] Int. Cl.[2] ..... B03C 3/00

[52] U.S. Cl. ..... 55/2; 55/137; 55/139

[58] Field of Search ..... 55/2, 137, 139

[56] References Cited

U.S. PATENT DOCUMENTS

| | | | |
|---|---|---|---|
| 1,356,462 | 10/1920 | Nesbit | 55/145 |
| 1,798,964 | 3/1931 | Wintermute et al. | 55/147 |
| 2,000,019 | 5/1935 | Heinrich et al. | 55/139 X |
| 2,000,020 | 5/1935 | Heinrich | 55/139 X |
| 2,440,455 | 4/1948 | White | 55/139 X |
| 2,509,548 | 5/1950 | White | 55/139 |
| 2,626,008 | 1/1953 | Barr | 55/147 X |
| 2,640,559 | 6/1953 | Hills | 55/139 X |
| 2,682,313 | 6/1954 | White | 55/139 X |
| 2,782,867 | 2/1957 | Hall | 55/139 |
| 2,813,595 | 11/1957 | Fields | 55/137 |
| 2,852,093 | 9/1958 | Streuber | 55/147 X |
| 3,191,362 | 6/1965 | Bourgeois | 55/139 X |
| 3,443,358 | 5/1969 | Drenning et al. | 55/2 |
| 3,641,740 | 2/1972 | Schumann et al. | 55/139 X |
| 3,654,747 | 4/1972 | Remick | 55/139 X |
| 3,727,380 | 4/1973 | Remick | 55/139 X |
| 3,778,970 | 12/1973 | Swimmer et al. | 55/137 |
| 3,816,980 | 6/1974 | Schwab | 55/139 X |
| 3,892,544 | 7/1975 | Haupt | 55/139 X |
| 3,915,672 | 10/1975 | Penney | 55/139 X |

FOREIGN PATENT DOCUMENTS

| | | | |
|---|---|---|---|
| 1031947 | 6/1966 | United Kingdom | 55/105 |

*Primary Examiner*—Bernard Nozick
*Assistant Examiner*—Kathleen J. Prunner
*Attorney, Agent, or Firm*—Russell & Nields

[57] ABSTRACT

An improved procedure is disclosed for supplying the power to an electrostatic precipitation system of the type wherein an underlying dc field serves to charge the particulates and transport them out of the stream of gas, while the corona which is required to yield ions to charge the entrained particulates is provided by a high, repetitively pulsed, electric field between the corona electrodes and collecting electrodes. The present disclosure reduces overall power input by connecting the corona electrodes in series and applying very narrow, frequent and high-amplitude pulses to one end of the series-connected cathode wire structure so that the pulses are propagated along the structure, thereby pulse-charging only a small portion of the precipitator at any given instant of time.

3 Claims, 5 Drawing Figures

REDUCED POWER INPUT FOR IMPROVED ELECTROSTATIC PRECIPITATION SYSTEMS

This is a continuation of application Ser. No. 609,708 filed Sept. 2, 1975, now abandoned, which is a continuation-in-part of Ser. No. 422,401, filed Dec. 6, 1973, now abandoned.

BACKGROUND

In my copending application, Ser. No. 281,405, filed on Aug. 17, 1972, now abandoned, for "Improved Electrostatic Precipitation", I have disclosed a procedure for the electrostatic precipitation of particulates entrained in a stream of gas between corona electrodes and collecting electrodes in which an underlying unidirectional field which serves to charge the particulates and transport them out of the stream is made relatively uniform, thereby allowing the creation of relatively high electric field intensities, while the corona which is required to yield ions to charge the entrained particulates is provided by a high, repetitively pulsed, electric field between the corona electrodes and the collecting electrodes. Such a system separates the charge and transport function from the function of production of charge carriers by corona discharge.

A number of other advantages are also comprehended by such systems:

(1) Presently existing electrostatic precipitators can be adapted to such systems without the necessity of major changes in the installation since the electrical circuitry may be quite simple.

(2) The wire breakage rates of such systems may be smaller than those of presently existing electrostatic precipitators since such systems allow corona electrodes of greater cross-sectional area than that acceptable in presently existing precipitators to be used.

(3) In such systems the pulsed field can be chosen sufficiently high that corona current is assured under virtually all operating conditions, thereby alleviating the very sensitive nature of conventional system electrodes to contamination, and the operative range of the dc field is greatly increased.

(4) Such systems also allow the average value of the corona current to be closely regulated independently of the dc field by adjusting the superimposed pulse voltage, pulse width, or pulse repetition rate. Thus, "back corona" can be controlled, and the minimum level adequate to charge the particulates close to their equilibrium state need not be significantly exceeded.

I have found, however, that such systems, especially converted conventional precipitators, may be costly to operate. A typical electric utility system with which the precipitator of the present invention might be used might be one with an electric power output of 7 megawatts. Assuming, for example, that the power is generated by burning coal, the products of combustion might result in a typical case in a gas flow of 50,000 cubic feet per minute. In order to clean this gas flow a typical total anode collecting area would be 20,000 square feet, and with typical wire-to-plate spacing the capacitance of the precipitator would be 100 nanofarads. A conventional rectified unfiltered dc system would have a total current of 1 ampere and a dc voltage of 70 kilovolts, thus resulting in a total power consumption of about 70 kilowatts. If the improvement described in my co-pending application Ser. No. 281,405, referred to above, were used for the conversion of such a conventional system to a pulsed system, the delivery of a pulse amplitude of 70 kilovolts thereto would require an energy of 735 joules per pulse to superimpose a single pulse onto the dc level. If one further assumes a pulse width of 100 nanoseconds, which I have suggested as typical for such systems, and ionization parameters such that a repetition frequency on the order of $10^4$ pulses per second is required to produce the necessary corona current, a total power consumption on the order of 7.35 MW is the result. Even $10^3$ pulses per second yields power consumption figures of 735 KW.

It will be noted that this power consumption has nothing to do with the useful power consumed in particulate removal, but is solely the reactive power required to charge the capacitance of the precipitator for purposes of the pulse. If sharp pulses are to be produced, as is necessary in the above improvement, it is necessary that the charge applied to the capacitance for purposes of the pulse must somehow be dissipated between pulses, and this is where the power loss occurs. It will be noted that in the above example at a repetition frequency of $10^4$ pulses per second the reactive power consumption exceeds that of the utility plant itself, and even at $10^3$ pulses per second the reactive power loss is over 10 percent.

The power discrepancy is clear. At present rates, the energy costs alone for a system such as the one described above would be around $160,000 per year. This figure is comparable to the present cost of the electrical portion of a conventional precipitator, and electric rates are rising steadily. Clearly, means are needed to reduce power requirements of improved systems if there are ever to be practical alternatives to conventional models, much less improvements thereon.

A reduction of pulse amplitude is one possible approach to this problem. This approach is unattractive, however, since it leads to a configuration and operation only slightly different from conventional dc charged precipitators, and it significantly reduces the usefulness and availability of the beneficial factor of controllable corona current. A reduction of pulse repetition frequency is also unattractive. It is possible to vary this parameter somewhat, but it will be desirable to provide sufficient charge carriers to charge the particulates close to their equilibrium value in a time which is short in comparison with the particle crossing time. Thus, given a representative drift velocity of 70 cm/sec, Cf. J. W. Parkington, M. S. Lawrie-Walker, "Attainment of High Precipitation Efficiencies on Fine and Sub-Micron Dusts and Fumes," LA PHYSIQUE DES FORCES ELECTROSTATIQUE ET LEURS APPLICATIONS, pp. 351–362, Grenable (1960), and an average perpendicular travel distance of 7 cm, for example, a repetition frequency far in excess of 10 pulses per second (pps) is indicated. One hundred pulses per particle crossing time, which would not be unusual, suggests 1000 pulses per second as a typical value for this parameter. Experiments with each specific system and particulate are necessary to determine optimal repetition frequency.

In addition to the excessive power requirements of pulsing a precipitator in the manner described above, in which the pulse voltage is applied to all the precipitator's wires simultaneously, a further problem is the difficulty in producing a short-rise time of the pulse. A typical inductance between the pulser and the cathode structure would be of the order of 1 microhenry. If one assumes therefore an inductance of one microhenry and if one considers a precipitator capacitance of 100 nf per pulser one arrives at a pulse rise time of approximately one-half microsecond. This time is already too long to take advantage of the increased hold-off strength of gases for short pulses. Differently stated, the excessive time required to reach the peak of the pulse effectively increases the pulse length obtainable.

SUMMARY OF THE INVENTION

The present invention connects the cathode wire structure in series in such a way that, in combination with the anode structure and support structure, a transmission line is formed to which the pulses are applied. The width of the pulse must be less than the length of the transmission line. As each pulse travels along the transmission line the cathode wires are sequentially charged, but only a small portion of the precipitator is charged at any given instant of time. In this way the necessary corona current is produced without the necessity of pulse charging each corona electrode simultaneously.

The series connection may be made either parallel to the direction of gas flow, that is along the support beam of each array of corona electrodes in the channels between the spaced collecting electrodes, or perpendicular to the direction of gas flow, that is back and forth across the top of the collecting electrodes connecting the corona electrodes having corresponding locations in each channel. The perpendicular configuration is considered the superior of these alternatives because it approximately equalizes the numbers of charge carriers emitted in each channel despite the pulse amplitude damping effects caused by the loss on the transmission line due to the corona current during propagation. The parallel configuration, on the other hand, emits a decreasing number of charge carriers in each channel as the pulse propagates from input toward the end of the series due to the same damping effects.

In each of the foregoing arrangements the corona wires form a multiplicity of spurs or branches each connected at one end thereof to a wire or cable which acts as the main body of the transmission line. In a preferred arrangement the length of the corona wire is itself used as part of the transmission line by connecting groups of corona wires end-to-end in series.

The benefits of the proposed system are strongly enhanced by previously experimentally established facts which demonstrated that the emitted charge per pulse is only slightly determined by pulse width, indicating that the charge is emitted during the very early part of the pulse when the shielding effects of the space charge cloud are absent. This fact allows use of very short pulses, on the order of 10nsec, which reduces power requirements as well as reducing the probability of an unwanted breakdown between the corona (cathode) wires and the collecting (anode) plates.

Since the power reduction achieved by the propagation system is proportional to the ratio of the pulse transit time through the series over the pulse width, such short pulses lead to total power consumption figures comparable to or less than present day requirements for dc systems.

The present improvement further contemplates use of well known circuitry in the pulse generating system, but notes that care must be taken to match the impedance of the transmission cable to the impedance of the wire cathode-anode geometry. The complicating fact that the corona wires have an electrical length comparable to a pulse width and thus will generate unwanted reflections, may be alleviated by connecting the corona wires in series both on the top and on the bottom. Alternatively, the corona wire length may itself form part of the main transmission line, as in the preferred embodiment of the invention, by connecting the corona wires end-to-end in series. Beyond this, however, experiments incorporating time domain reflectrometry measurements and pulse amplitude decay along the propagation path are recommended in order to obtain optimal matching conditions for each specific system.

At the end of the series-connected wires, the pulse will be reflected back and will again contribute to the production of corona current on the return path. These reflections will have died out, however, before the next pulse is applied, thus anticipating and avoiding a possible troublesome source of sparkover.

DETAILED DESCRIPTION OF THE PRESENT IMPROVEMENT

Figure 1:
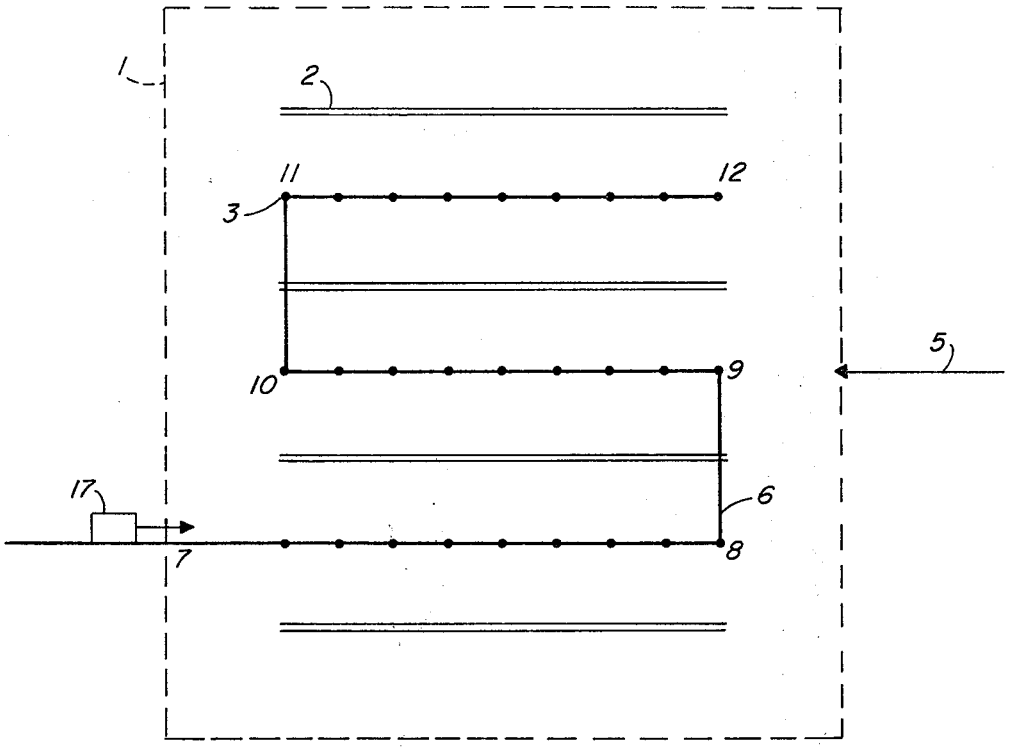
FIG. 1 is a schematic diagram of a high-tension bus section of an improved electrostatic precipitator wherein the corona (cathode) electrodes of each array are connected in series along their common support beam by connecting means, and wherein each such series-connected array is connected in series by connecting means with the series-connected arrays located in the adjoining channels across the top of the collecting anode plates on either side of each array so that a single continuous path is formed from input to end.
Figure 2:
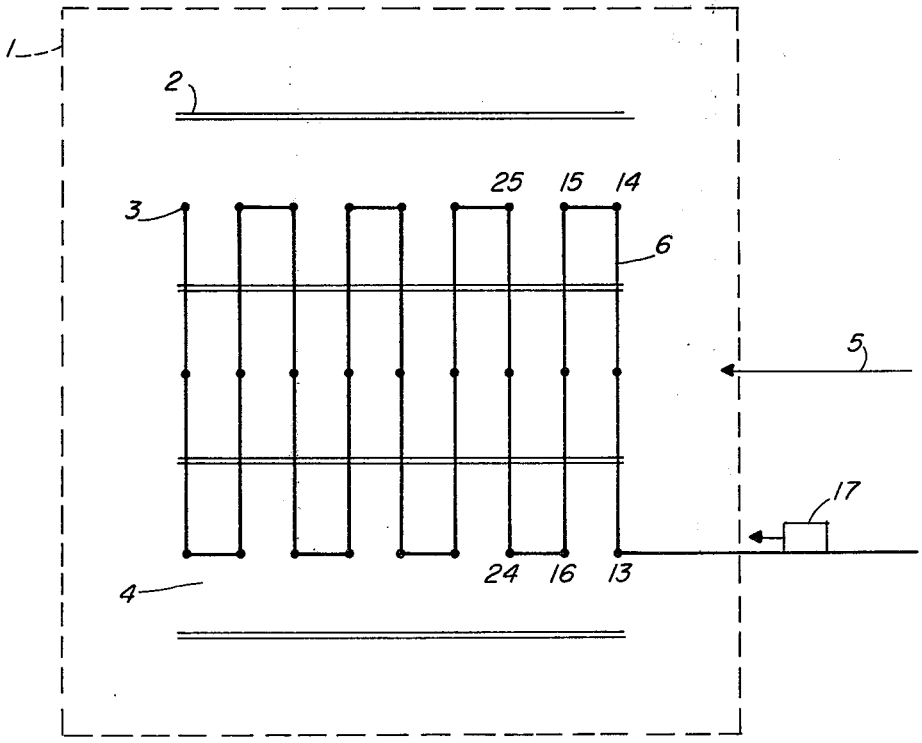
FIG. 2 is a schematic diagram of a high-tension bus section of an improved electrostatic precipitator wherein the corona (cathode) electrodes having corresponding positions in the channels between each pair of collecting (anode) plates are connected in series across the tops of the collecting plates by connecting means, and wherein each such series-connected row is connected in series by connecting means with the series-connected rows on either side of it along an array support beam such that a single continuous path is formed from input to end.
Figure 4:
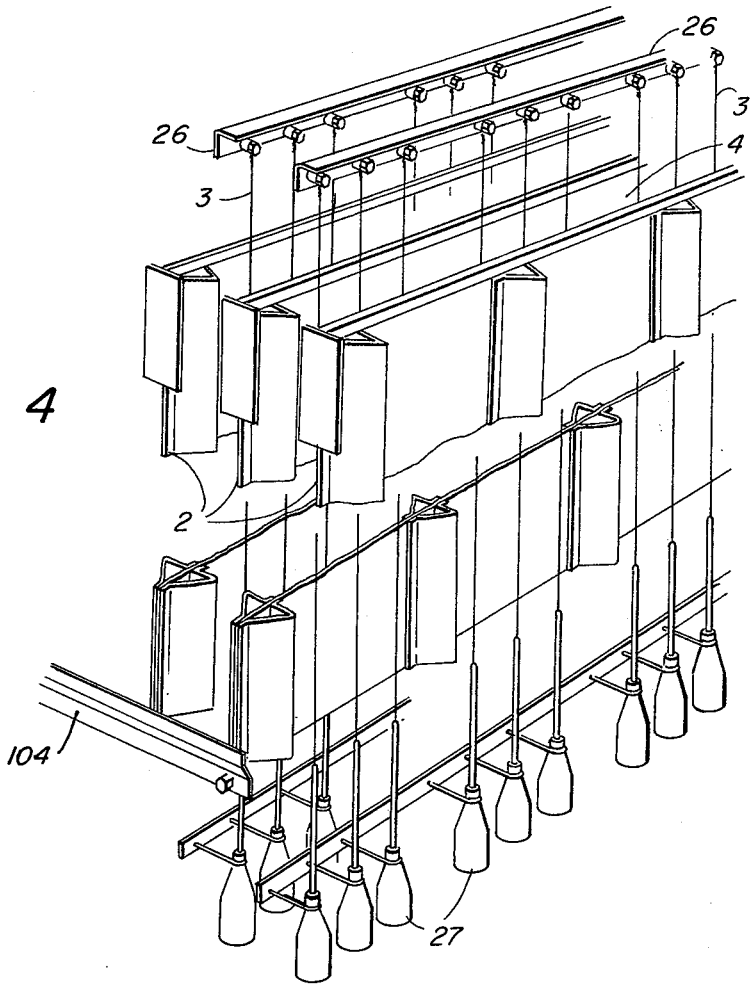
FIG. 4 is a three-dimensional view of the electrode configuration of a typical duct-type precipitator used for collection of fly ash.

In FIGS. 1 and 2 of the drawing there is shown a schematic diagram of a representative high-tension bus section 1 of an improved electrostatic precipitator which includes a plurality of spaced, metallic collecting (anode) electrode plates 2 and a plurality of metallic, individually insulated corona (cathode) electrodes 3 of relatively small surface area positioned within the channel-like spaces 4 midway between each pair of collecting electrodes 2. FIG. 4, a three-dimensional view of a portion of such a high-tension bus section, clearly shows the relative physical relationships of this configuration.

It should be noted that the configuration indicated in FIG. 4 includes a plurality of support beams 26, which, together with the anodes 2 and cathodes 3 and related structures form a transmission line 6 in embodiments similar to FIG. 1, positioned above the channel-like spaces 4 midway between the pairs of collecting plates 2. (Also, note that support 104 upon which the collecting electrodes 2 rest is generally grounded and rigidly attached to an external support (not shown) such as a wall of a duct in which the unit is operationally placed.) The corona electrodes 3, in this specific embodiment wires, are attached to the support beams 26 and are held vertical by means of fixed connections, in this case weights 27, positioned directly below the support beams 26 under the channel-like spaces 4. Thus, corona electrodes 3 form a plurality of arrays which are substantially vertical and rest in planes substantially parallel to the planes of the collecting plates 2.

In a typical installation each cathode wire 3 might be 30 feet high, each row of cathode wire 3 might be 10 feet wide, and the unit might comprise 50 rows spaced 10 inches apart. A complete installation might include six such units.

Instead of energizing each dc charged corona electrode 3 within each high-tension bus section 1 at the same time with a continuous repetition of superimposed high voltage pulses from the same power source, the present improvement contemplates energizing the bus section 1 as a unit by propagating a very narrow pulse 17 along a series-connected cathode wire structure, thereby energizing each dc charged corona electrode 3 in the series in turn, not simultaneously, thus reducing total power consumption while maintaining the necessary corona current.

In the typical installation referred to above, each unit would provide a transmission line length of 500 feet. Since each pulse travels along the transmission line with a velocity slightly less than that of light, a 10-nanosecond pulse would have a pulse length of 10 feet, so that only a small portion of each would be charged at any one instant of time.

FIG. 1 specifically shows one way in which high-tension bus section may be wired to produce the required series-connected cathode wire structure. The configuration therein shows the metallic and individually insulated corona electrodes 3 connected in series along the support beams 26 of the arrays, this is parallel to the gas flow direction 5, and each such series-connected array connected across the top of the adjoining collecting electrode plate 2 in series with the next succeeding series-connected array. The representative series pattern thus created runs from input point 7 to point 8, to point 9, to point 10, to point 11, to point 12, as is clearly shown in FIG. 1. All of the above recited connections result in the formation of the transmission line 6.

Care must be taken to reduce unwanted reflections in the transmission line. Discontinuities such as the connections between the cathode wires 3 and the support beams 26 will introduce reflections which must be compensated, and interconnections between rows of cathode wires 3 will introduce inductance causing similar reflections. Such reflections may be reduced by providing appropriate circuit elements such as inductances, capacitances, etc. at suitable locations along the transmission line. The nature and magnitude of such circuit elements cannot be calculated in advance. However, by well-known techniques any actual installation can be analyzed and suitable circuit elements provided.

FIG. 2 shows another way in which a high-tension bus section may be wired to produce the required series-connected cathode wire structure. The configuration therein shows the metallic and individually insulated corona electrodes 3 having corresponding locations in each channel-like space 4 connected in series across the top of the collecting electrode plates 2, that is perpendicular to the gas flow direction 5, and each such series-connected row connected in series with the adjoining series-connected row along the appropriate support beam 26 in a direction parallel to the gas flow direction 5. Thus, the pulse delay connecting means or transmission line 6 will form a series of "s" patterns, that is patterns following the form shown clearly in FIG. 2 running from point 13, to point 14, to point 15, to point 16, to point 24, to point 25.

Figure 3:
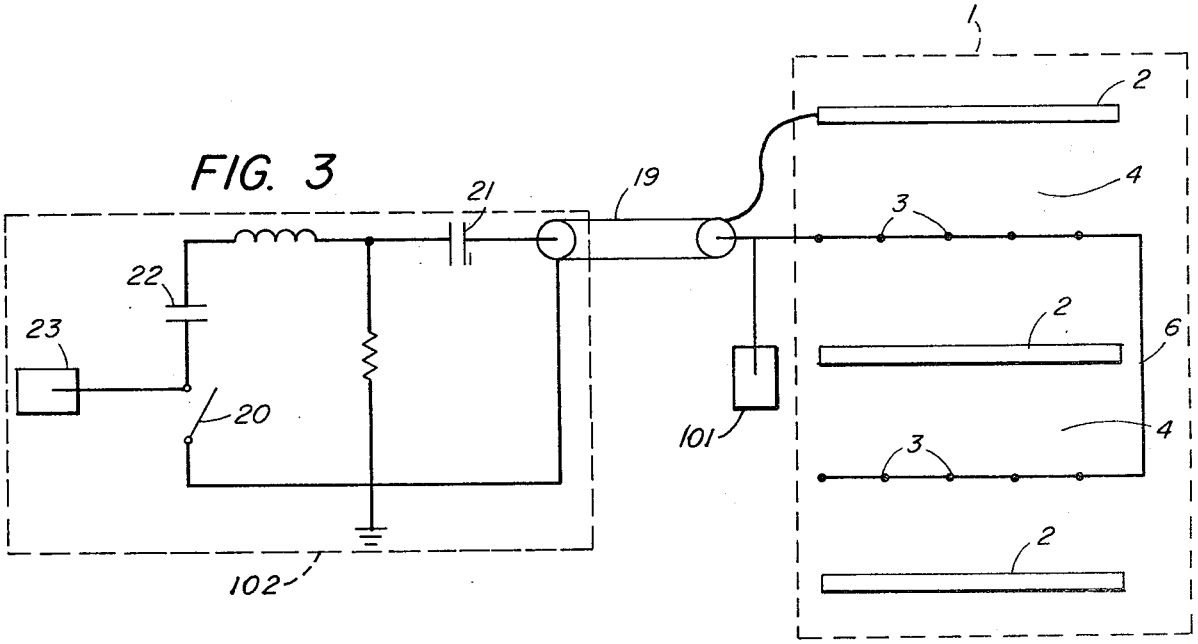
FIG. 3 is a schematic diagram of a typical circuit for pulse generation showing its connection to an improved electrostatic precipitator having its corona electrodes connected as shown in FIG. 1.

In combination with either of the two above recited manners of wiring the series-connected wire structure, the present improvement comprehends a source of base dc voltage 101 and a pulse generating network 102 capable of providing short pulses to the appropriate high-tension bus section via the transmission cable 19 as shown in FIG. 3. The specific embodiment of the pulse generation network herein shows a system of capacitors, inductors, and resistors such that the pulse storage capacitor 22 is charged from an external power supply 23 until the desired voltage is reached. At this point the storage capacitor 22 is discharged via a suitable device such as a triggered switch 20, thereby applying a pulse signal to the transmission cable 19 via a coupling capacitor 21 and thence to transmission line 6.

The necessary corona current to provide ions for the charging of the particulates is thus achieved as a result of the pulsed high potential superimposed on the base dc level by the pulse generating mechanism as exemplified by the pulse forming network, FIG. 3, in conjunction with the pulse propagating characteristics of the series-connected cathode wire structure. The pulsed field thereby induced may still be significantly higher than the underlying dc field without resulting in gas breakdown since the pulsed potentials remain of very short duration. The use of the pulse propagation characteristics, however, yields significantly favorable effects on total power consumption since only a few instead of all, of the corona electrodes need now be pulse charged at any given instant of time. Consumption figures are now possible in a range comparable to or less than conventional dc systems. In fact, the present improvement reduces power consumption at a rate proportional to the ratio of pulse transit time over the pulse width. Thus, if an existing 1000 wire dc precipitator configuration, wherein spacings between corona electrodes of 6 to 8 inches are not uncommon, and a 10 nanosecond pulse width are considered, the superimposition of pulses of a 69 kv amplitude upon a base dc level of 69 kv ten thousand times per second would consume about 7.15 MW of power, while the present improvement would reduce this figure to about 110 kw, a reduction by a factor of 65.

As is the case in improved systems, the superimposed voltage in the present configuration is comprehended to be at least 10% of the underlying dc wire voltage and typically of approximately the same magnitude as the dc wire voltage. Similarly, the pulse repetition rate should also be at least 1000 pulses per second (pps) and preferably higher, on the order of several thousand pps, if the particulates to be precipitated are not high resistivity particulates. For high resistivity dust the pulse repetition frequency is controlled by back corona and might be as low as several tens of pulses per second.

The superimposed potential will preferably still have a pulse width in the range between $10^{-9}$ and $10^{-7}$ seconds, but a typical pulse width in the present system would be about 10 nanoseconds. This further refinement of improved systems is based upon previously experimentally established facts which demonstrated that the emitted charge per pulse is only slightly determined by pulse width, while being primarily determined by the amplitudes superimposed and the waveform geometry presented. These facts indicate that the charge is emitted during the very early part of the pulse when the shielding effects of the space charge cloud are absent. This allows the pulses used to be extremely short, which not only reduces power requirements but also reduces the probability of unwanted breakdown between the cathode wires 3 and the anode plates 2.

The above experimentally established facts also indicate an operational advantage the configuration of FIG. 2 has over that of FIG. 1. The corona current will act as a loss on the transmission line 6 and will slowly reduce the pulse amplitude as it travels along its path. Thus, since the quantity of emission depends significantly upon pulse amplitude, the emissions produced in each channel 4 will vary more in FIG. 1 than in FIG. 2.

The above-mentioned damping effect incidentally yields another beneficial result. At the end of the series-connected wires, the pulse will be reflected back and will again contribute to the production of corona current on its return path. These reflections will have damped out, however, by the time the next pulse is applied, thereby reducing the probability of breakdown due to pulse-adding.

Figure 5:
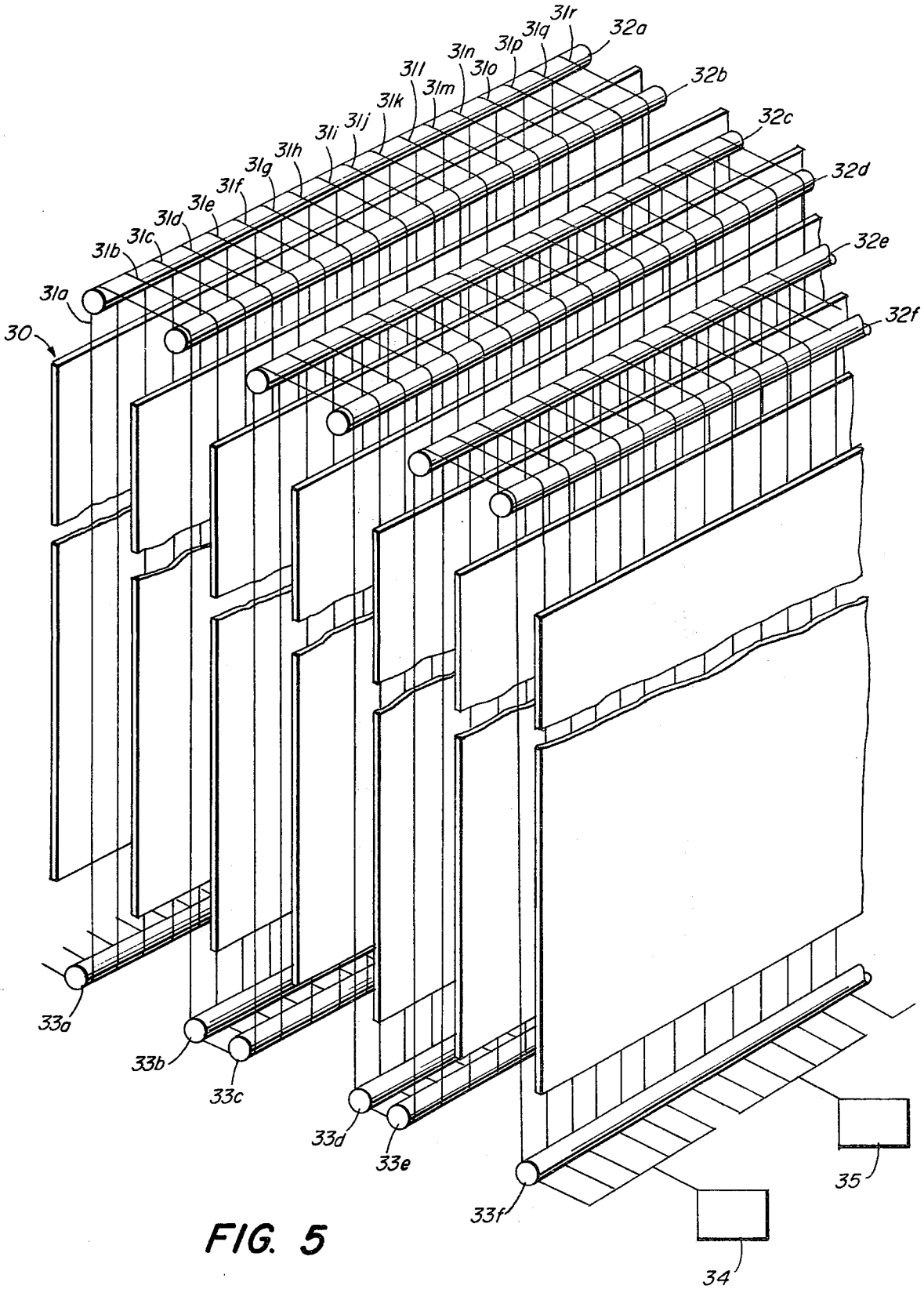
FIG. 5 is a three-dimensional view of a preferred embodiment of the invention, showing the electrode configuration and transmission-line circuitry.

A preferred connection of the cathode wires in accordance with the invention is shown in FIG. 5. Referring thereto the collecting plates 30 are arranged in a manner similar to that of the collecting plates 2 shown in FIGS. 1–4. However, whereas the corona wires 3 of each section of FIGS. 1–4 are essentially in parallel, in the preferred embodiment of FIG. 5 the corona electrodes are connected to form one or more transmission lines represented in FIG. 5 schematically as long wires 31*a*–31*r* each of which lies approximately in a plane perpendicular to the planes in which the collecting plates 30 are disposed, each such wire extending between adjacent collecting plates and thence sequentially from one interplate gap to the next, passing alternatively above and below successive collecting plates 30. The corona electrodes 31 are supported upon an upper array 32 and a lower array 33 of beam members. The upper array of beam members 32 comprises a series of rows 32*a*–32*f*, and in each such row the beam members thereof are arranged longitudinally of one another approximately midway between neighboring collecting plates 30 but spaced above them. Similarly, the lower array of beam members 33 comprises a series or rows 33*a*–33*f* in each of which the beam members belonging to that row are arranged longitudinally of one another approximately half-way between adjacent collecting plates 30 but spaced below them. Thus, in FIG. 5 each elongated wire 31*a*–31*r* proceeds sequentially from beam member 33*a* to beam member 32*a* and so on sequentially through beam members 32*b*, 33*b*, 33*c*, 32*c*, 32*d*, 33*d* 33*e*, 32*e*, 32*f*, 33*f* as shown. The elongated wires 31 are driven by pulsers, and a single pulser can drive a number of parallel wires.

One of the advantages of the embodiments shown in FIG. 5 is that the impedance of each elongated wire may easily be calculated. Each elongated wire is essentially a single wire between grounded parallel planes as a ground return. This is a simple configuration and the impedance of such a wire is given for example at page 22–23 item P of Reference Data for *Radio Engineers* (*Fifth Edition*), Howard W. Sama and Co., Inc. ITT. As therein shown, the characteristic impedance $Z_o$ in ohms of one wire between grounded plates spaced apart a distance h, where the diameter of the wire d is measured in the same units as h, is $(138/\sqrt{\epsilon})\log_{10}(4h/\pi d)$ where $\epsilon$ is the dielectric constant of the medium in which the wire is placed relative to that in air. This equation gives the impedance presented to a pulse by the wire; it does not depend upon the length of the line. In a typical precipitator constructed in accordance with this invention the spacing between parallel plates would be 9 inches and a typical wire diameter would be ¼ inch. Substituting these values in the above equation, the impedance of a typical wire would be 230 ohms. Six parallel cables of this nature would therefore have an impedance of 1/6 of 230 or 38.3 ohms. Consequently, 6 parallel wires of this nature could easily be driven by one pulser via a cable of an impedance which is close to the 38 ohms of the wire arrangement. For example, as shown in FIG. 5, elongated wires 31*a*–31*f* might be driven by one pulser 34, while elongated wires 31 *g*–31*l* might be driven by a second pulser 35. The invention comprehends the use of any number of pulsers, and indeed a single pulser may be used to drive an entire section of a precipitator.

A major feature of the embodiment shown in FIG. 5 is the ease with which impedance may be matched. For example, the pulsers can be located in a room several hundred feet from the plates and wires of the precipitator itself, and the pulses may be transmitted from the pulsers to the corona wire by a standard cable the impedance of which is simply $\sqrt{L/C}$ (where L is the inductance and C the capacitance of the cable). Such a cable will have a given inductance per unit length and a given capacitance per unit length, so that the impedance of the cable is easily calculated. Having done so, it is then a simple matter to match the impedance of the cable to that of the corona wires simply by appropriate selection of the number of wires to which each pulser is connected. This calculation is also simple since, as set forth above, the configuration of the embodiment of FIG. 5 is simply a single wire between grounded parallel planes the impedance of which is well known and easily calculated.

Since a typical precipitator has approximately 30 to 40 channel-like spaces perpendicular to the gas flow, and since the length of one wire is on the order of 30 feet, one arrives at a continuous wire length of 900 to 1,800 feet for each of the elongated wires shown in the arrangement of FIG. 5. Such an arrangement therefore arrives at a wire length which is longer than one obtains when making the connections of the corona electrodes in the manner shown in FIG. 1 or FIG. 2. Moreover, the arrangement of FIG. 5 is more compatible with present feeding arrangements of the dc voltage than the arrangement shown in FIGS. 1 and 2. For this reason the arrangement of FIG. 5 is preferred.

It is to be understood that the embodiments of the improvement herein described are intended to be illustrative and exemplary and not limiting. It will be apparent to one skilled in the art that derivations may be made to adapt the improvement to particular circumstances and parameters and that such adaptations may be made without departing from the spirit of the improvement, which is defined in the following claims. It is recommended, however, that in adapting the present improvement to a specific set of circumstances and parameters, care be taken to obtain optimal impedance matching conditions between the transmission cable and the wire cathode-anode geometry, preferably via experiments incorporating both time domain reflectrometry measurements and pulse amplitude decay along the path of propagation. It is further suggested that in the embodiments of FIGS. 1 and 2, the complicating fact that the corona wires themselves have an electrical length comparable to a pulse width, which causes unwanted reflections, may be alleviated by making the above recited connections both on the top and on the bottom of the precipitator.

Throughout the specification and claims, the term "pulse width" is used in the conventional sense, being measured at full width half maximum (i.e. "FWHM"). That is to say, the pulse width is the amount of time which elapses between the instant when the voltage pulse reaches half its maximum voltage and the instant when the voltage drops to half its maximum voltage.

I claim:

1. A method of pulse-charging the electrode system of an electrostatic precipitator, said electrode system comprising corona electrodes interconnected by electric conductors to form a corona electrode system and collector electrodes interconnected by electric conductors to form a collector electrode system, said collector electrode system and said corona electrode system being juxtaposed so as to form the electrode system capable of producing corona at said corona electrodes when a voltage applied across said electrode system is at a corona-producing level, which method comprises raising the voltage across only a portion of said electrode system to a corona-producing level so that the voltage across said portion returns to a non-corona producing level before said raised voltage has reached the remainder of said electrode system.

2. Electrostatic precipitator comprising a corona-electrode support structure, a plurality of corona electrodes supported upon said corona-electrode support structure, conductors interconnecting said corona-electrodes, so that a corona electrode system is formed having a pulse-input end, a collector electrode system cooperating with said corona electrode system to form an operative precipitator structure capable of producing corona at any corona electrode when the voltage thereof is at a corona-producing level, a voltage source, switch means for applying voltage from said voltage source to said pulse-input end, said voltage source and said switch means being adapted to raise the voltage of only a portion of said corona electrode system to a corona-producing level so that said voltage returns to a non-corona-producing level before the entire corona electrode system reaches said voltage.

3. Electrostatic precipitator according to claim 19, wherein said corona electrode system comprises a multiplicity of substantially geometrically parallel corona electrodes and said conductors comprise electrical connections between several adjacent ends of several adjacent corona electrodes so that these electrical connections connect these several corona electrodes in series end-to-end.

* * * * *